US010847312B2

(12) United States Patent
Ohkubo et al.

(10) Patent No.: US 10,847,312 B2
(45) Date of Patent: Nov. 24, 2020

(54) COIL COMPONENT

(71) Applicant: TDK CORPORATION, Tokyo (JP)

(72) Inventors: Hitoshi Ohkubo, Tokyo (JP); Masazumi Arata, Tokyo (JP); Takahiro Kawahara, Tokyo (JP); Hokuto Eda, Tokyo (JP); Hiroki Tsujiai, Tokyo (JP)

(73) Assignee: TDK CORPORATION, Tokyo (JP)

( * ) Notice: Subject to any disclaimer, the term of this patent is extended or adjusted under 35 U.S.C. 154(b) by 235 days.

(21) Appl. No.: 16/027,639

(22) Filed: Jul. 5, 2018

(65) Prior Publication Data

US 2019/0013148 A1 Jan. 10, 2019

(30) Foreign Application Priority Data

Jul. 10, 2017 (JP) ..... 2017-134871

(51) Int. Cl.

| | |
|---|---|
| ***H01F 27/28*** | (2006.01) |
| ***H01F 41/04*** | (2006.01) |
| ***H01F 17/00*** | (2006.01) |
| ***H01F 27/32*** | (2006.01) |
| ***H01F 27/29*** | (2006.01) |
| ***H01F 17/04*** | (2006.01) |

(52) U.S. Cl.

CPC ..... *H01F 41/04* (2013.01); *H01F 17/0013* (2013.01); *H01F 17/045* (2013.01); *H01F 27/2804* (2013.01); *H01F 27/292* (2013.01); *H01F 27/324* (2013.01); *H01F 2017/0066* (2013.01)

(58) Field of Classification Search

CPC .... H01F 41/04; H01F 17/0013; H01F 17/045; H01F 17/0006; H01F 2017/0066; H01F 2017/048; H01F 27/2804; H01F 27/324; H01F 27/292; H01F 27/323; H01F 27/29

USPC ..... 336/200, 223, 192

See application file for complete search history.

(56) References Cited

U.S. PATENT DOCUMENTS

2013/0222101 A1* 8/2013 Ito ..... H01F 5/003 336/83
2013/0249662 A1* 9/2013 Tonoyama ..... H01F 17/0013 336/200
2015/0048915 A1* 2/2015 Yoon ..... H01F 17/0013 336/192

(Continued)

FOREIGN PATENT DOCUMENTS

| | | |
|---|---|---|
| CN | 103180919 A | 6/2013 |
| CN | 105655101 A | 6/2016 |
| JP | 2016-103591 A | 6/2016 |

*Primary Examiner* — Mang Tin Bik Lian
(74) *Attorney, Agent, or Firm* — Oliff PLC

(57) ABSTRACT

In a planar coil element, since an overlapping portion of a fourth resin wall of a first conductor pattern protrudes from an end surface of a main body portion, restriction on a width of the overlapping portion is relaxed, and the wide overlapping portion is realized. Therefore, an improvement in a withstand voltage between the second external terminal electrode formed on the end surface and an outermost turn of the first conductor pattern is realized. Similarly, regarding the second conductor pattern, the improvement in the withstand voltage between the first external terminal electrode formed on the end surface and an outermost turn of the second conductor pattern is realized.

5 Claims, 4 Drawing Sheets

(56) References Cited

U.S. PATENT DOCUMENTS

2016/0155556 A1* 6/2016 Ohkubo ..... H01F 41/043
336/83
2016/0268038 A1* 9/2016 Choi ..... H01F 27/255

* cited by examiner

COIL COMPONENT

CROSS-REFERENCE TO RELATED APPLICATIONS

This application is based upon and claims the benefit of priority from Japanese Patent Application No. 2017-134871, filed on 10 Jul. 2017, the entire contents of which are incorporated herein by reference.

TECHNICAL FIELD

An aspect of the present invention relates to a coil component.

BACKGROUND

As a conventional coil component, for example, Japanese Unexamined Patent Application Publication 2016-103591 (Patent Document 1) discloses a coil component having a magnetic main body including coil conductor patterns formed on both surfaces of an insulating substrate. In the coil component of Patent Document 1, resin walls are formed on the insulating substrate, and then the coil conductor patterns are plated and grown to fill a space between the resin walls. Therefore, the resin walls are located inside an innermost turn, and outside an outermost turn between turns of each coil conductor pattern. Further, the plated and grown coil conductor patterns are covered with a magnetic element body together with the resin walls, and the resin walls remain in the finished coil component.

SUMMARY

In the coil component according to the prior art as described above, an external terminal electrode is provided to cover the entire facing end surfaces from which the coil conductor patterns are drawn out. Since substantially no potential difference is generated between the external terminal electrode and the coil conductor pattern connected thereto but a relatively large potential difference is generated between the external terminal electrode and the other coil conductor pattern which is not connected, a high withstand voltage is required.

According to the present invention, there is provided a coil component with an improved withstand voltage.

According to an aspect of the present invention, there is provided a coil component which comprises a main body portion having a first end surface and a second end surface facing each other, and a first external terminal electrode and a second external terminal electrode respectively formed on the first end surface and the second end surface of the main body portion, wherein the main body portion includes an insulating substrate configured to extend in a direction in which the first end surface and the second end surface face each other; a coil having a first coil conductor pattern formed on one surface of the insulating substrate and having an outer end portion extending to the first end surface and connected to the first external terminal electrode, a second coil conductor pattern formed on the other surface of the insulating substrate, extending to the second end surface to be connected to the second external terminal electrode and wound in a winding direction opposite to that of the first coil conductor pattern when seen in a thickness direction of the insulating substrate, and a through-hole conductor provided to pass through the insulating substrate and configured to connect inner ends of the first coil conductor pattern and the second coil conductor pattern; resin walls disposed between turns of each of the first coil conductor pattern and the second coil conductor pattern and disposed on an inner side of an innermost turn and on an outer side of an outermost turn of each of the first coil conductor pattern and the second coil conductor pattern; and a magnetic element body provided on one surface and the other surface of the insulating substrate to cover the first coil conductor pattern, the second coil conductor pattern and the resin walls and configured to form an outer shape including the pair of end surfaces of the main body portion, an outer end portion of the first coil conductor pattern and the resin wall located outside the outermost turn of the second coil conductor pattern of an overlapping portion overlapping the outer end portion in a thickness direction of the insulating substrate protrude from the first end surface of the main body portion, and an outer end portion of the second coil conductor pattern and the resin wall located outside the outermost turn of the first coil conductor pattern of an overlapping portion overlapping the outer end portion in the thickness direction of the insulating substrate protrude from the second end surface of the main body portion.

In the coil component, since the overlapping portion of the resin wall located outside the outermost turn of the first coil conductor pattern protrudes from the second end surface of the main body portion, a width (length in a direction of the end surface) of the overlapping portion in a direction in which the first end surface and the second end surface face can be designed to be wide. In this case, a withstand voltage between the second external terminal electrode formed on the second end surface and the outermost turn of the first coil conductor pattern is improved. Since the overlapping portion of the resin wall located outside the outermost turn of the second coil conductor pattern also protrudes from the first end surface of the main body portion, a width of the overlapping portion in the direction in which the first end surface and the second end surface face can be designed to be wide. In this case, the withstand voltage between the first external terminal electrode formed on the first end surface and the outermost turn of the second coil conductor pattern is improved.

According to the coil component according to another aspect of the present invention, in the first coil conductor pattern, a width of the overlapping portion of the resin wall located outside the outermost turn may be wider than a width of the resin wall positioned between the turns.

According to the coil component according to still another aspect of the present invention, the first external terminal electrode may protrude outward in a region which covers the outer end portion of the first coil conductor pattern protruding from the first end surface of the main body portion and the overlapping portion of the resin wall located outside the outermost turn of the second coil conductor pattern.

According to the coil component according to yet another aspect of the present disclosure, the first external terminal electrode and the second external terminal electrode may be resin electrodes. In this case, a high coupling force is realized between the first external terminal electrode and the resin wall and between the second external terminal electrode and the resin wall.

According to the coil component according to still yet another aspect of the present disclosure, each of the first coil conductor pattern and the second coil conductor pattern may have an elliptical shape formed by two semicircular arcs facing each other in a direction in which the first end surface and the second end surface face each other and two straight lines connecting end points of the two semicircular arcs when seen in the thickness direction of the insulating substrate.

DETAILED DESCRIPTION

Figure 1:
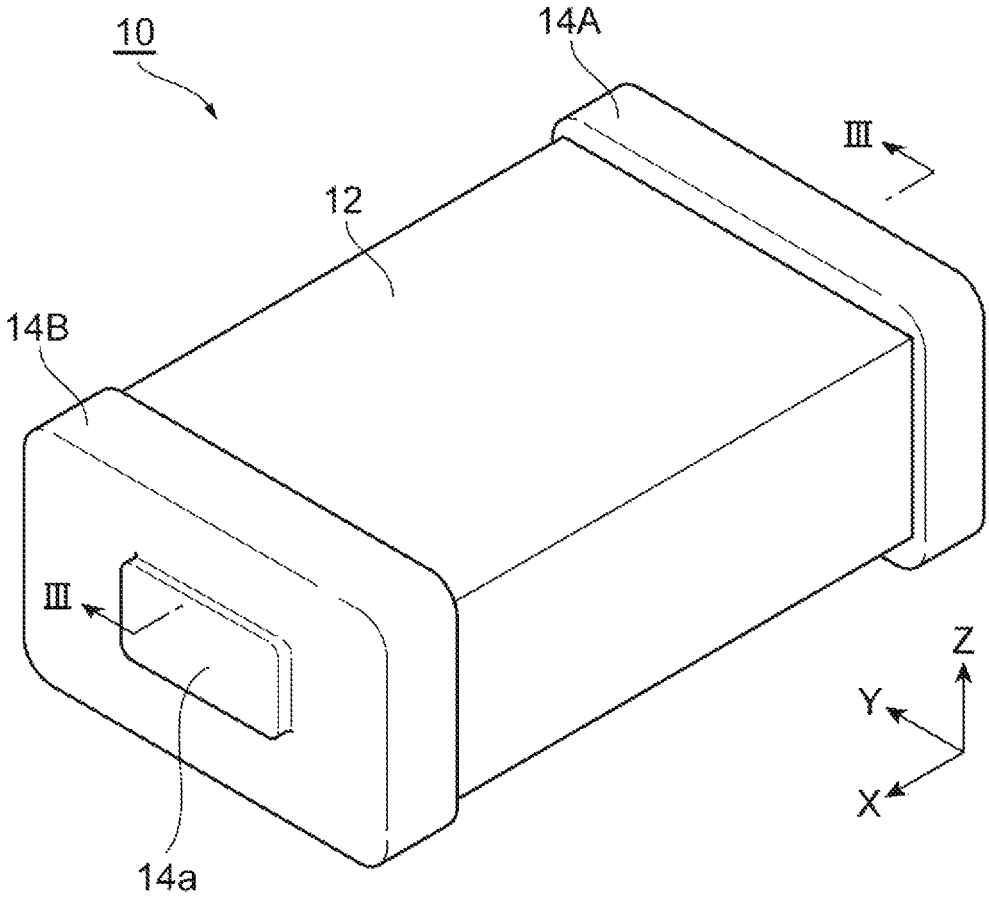
FIG. 1 is a schematic perspective view of a planar coil element according to an embodiment.

Hereinafter, embodiments of the present invention will be described in detail with reference to the accompanying drawings. In the description, the same elements or elements having the same function are designated by the same reference numerals, and repeated description will be omitted.

A structure of a planar coil element which is one type of coil component according to the embodiment of the present invention will be described with reference to FIGS. 1 to 4. For convenience of explanation, XYZ coordinates are set as illustrated. That is, a thickness direction of the planar coil element is defined as a Z direction, a direction in which an external terminal electrode faces is defined as an X direction, and a direction orthogonal to the Z direction and the X direction is defined as a Y direction.

A planar coil element 10 includes a main body portion 12 having a rectangular parallelepiped shape and a pair of external terminal electrodes 14A and 14B provided to cover a pair of facing end surfaces 12*a* and 12*b* of the main body portion 12. As an example, the planar coil element 10 is designed to have dimensions of a long side of 2.5 mm, a short side of 2.0 mm and a height of 0.8 to 1.0 mm.

The main body portion 12 includes an insulating substrate 20 and a coil C provided on the insulating substrate 20.

The insulating substrate 20 is a plate-shaped member formed of a nonmagnetic insulating material and has a substantially elliptical annular shape which is long in the X direction when seen in the thickness direction thereof. An elliptical through-hole 20*c* which is long in the X direction is provided in a center portion of the insulating substrate 20. In the specification, the elliptical shape and the elliptical annular shape are shapes formed by two semicircular arcs facing each other and two lines connecting end points of the two semicircular arcs. The two lines connecting the end points of the semicircular arcs may be straight lines or curved lines. Such shapes include an ellipse. As the insulating substrate 20, a substrate having a glass cloth impregnated with an epoxy-based resin and having a thickness of 10 μm to 60 μm can be used. A BT resin, polyimide, aramid or the like can also be used instead of the epoxy-based resin. A ceramic or glass can also be used as a material of the insulating substrate 20. The material of the insulating substrate 20 may be a mass-produced printed circuit board material or may be a resin material used for a BT printed board, an FR4 printed board, or an FR5 printed board.

The coil C includes a first conductor pattern 22A for a planar air-core coil provided on one surface 20*a* (upper surface in FIG. 2) of the insulating substrate 20, a second conductor pattern 22B for a planar air-core coil provided on the other surface 20*b* (lower surface in FIG. 2) of the insulating substrate 20, and a through-hole conductor 25 which connects the first conductor pattern 22A with the second conductor pattern 22B.

Figure 2:
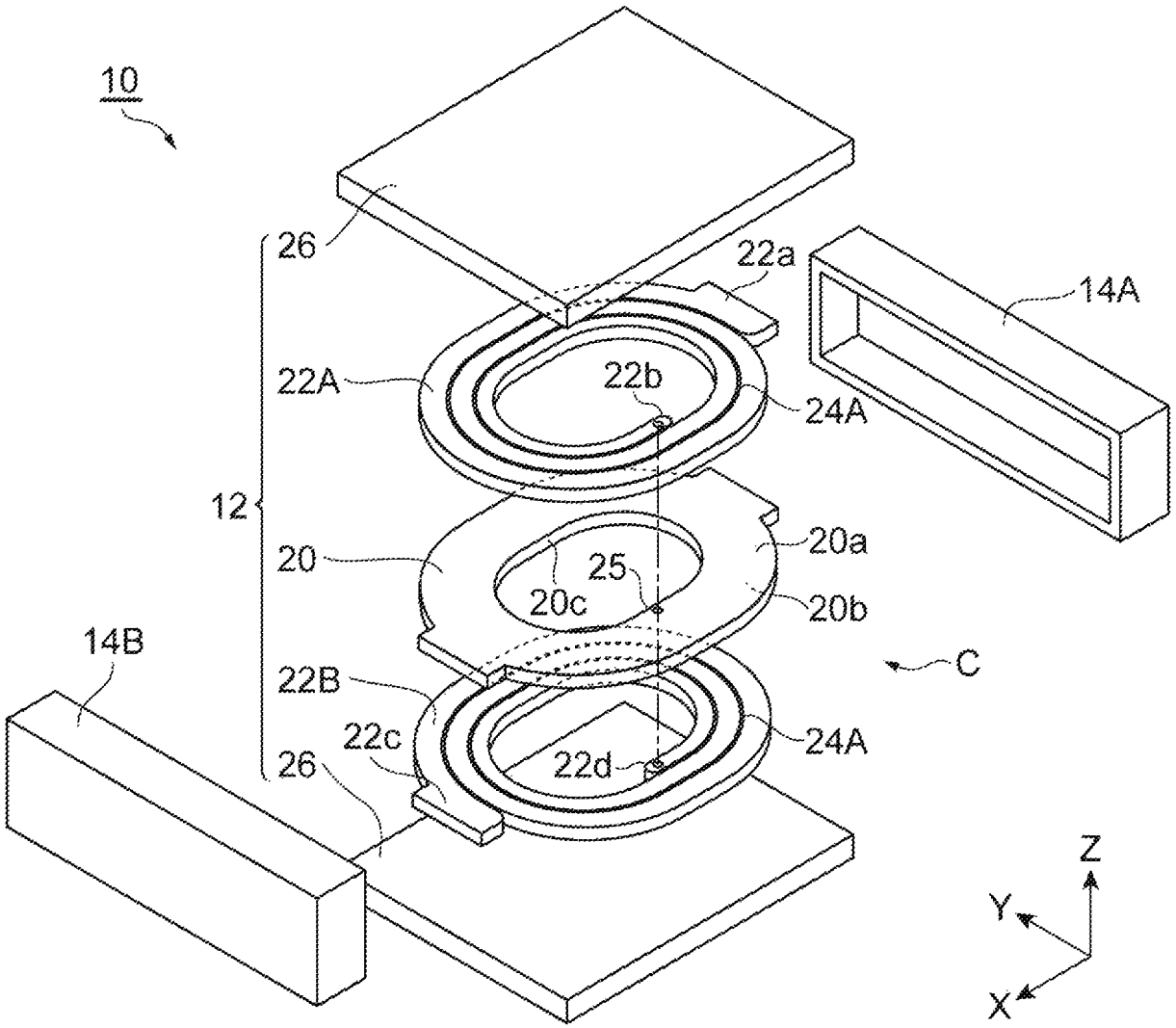
FIG. 2 is an exploded view of the planar coil element illustrated in FIG. 1.
Figure 4:
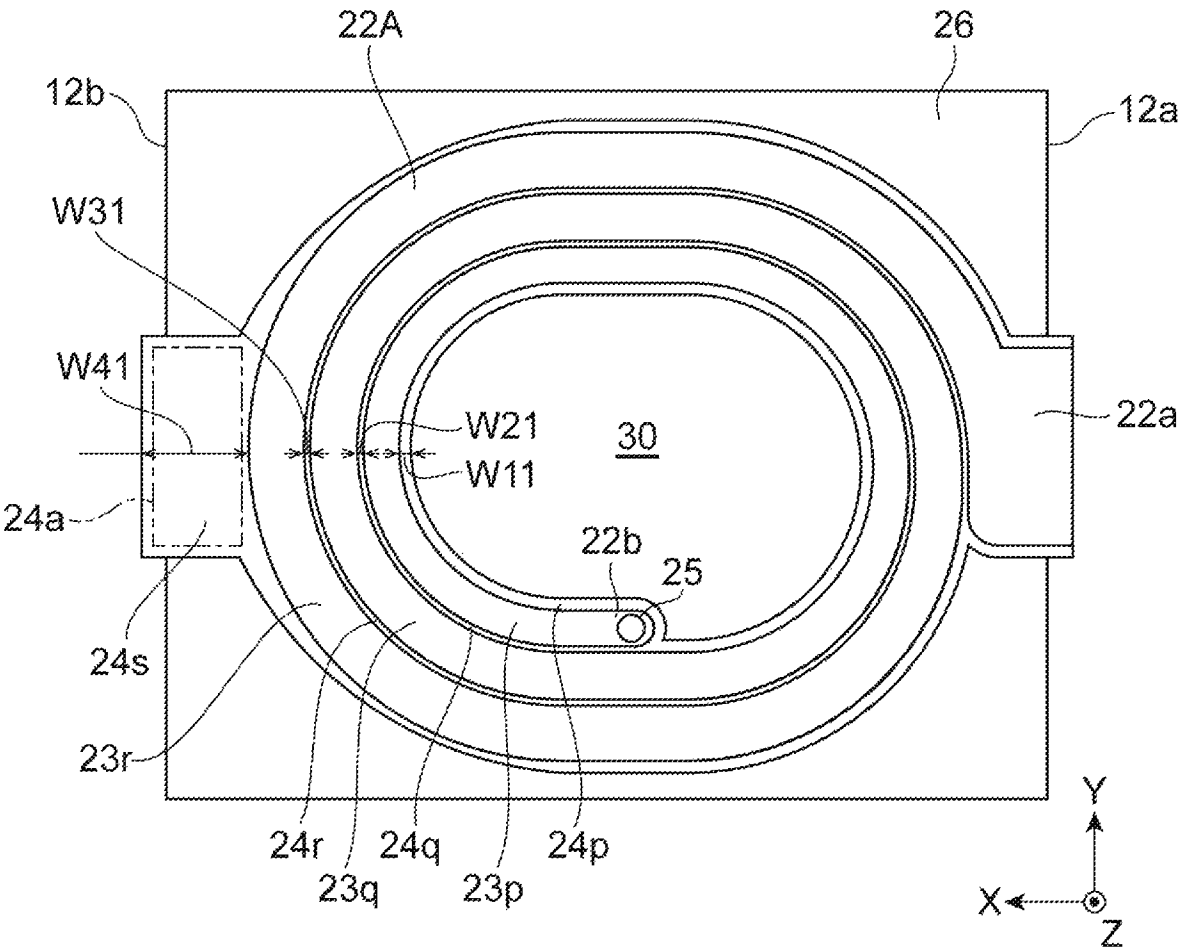
FIG. 4 is a plan view illustrating a first conductor pattern of the planar coil element illustrated in FIG. 1.

The first conductor pattern 22A (first coil conductor pattern) is a planar spiral pattern which becomes a planar air-core coil and is plated with a conductive material such as Cu. The first conductor pattern 22A is formed to be wound around the through-hole 20*c* of the insulating substrate 20. That is, like the through-hole 20*c*, the first conductor pattern 22A has an elliptical shape which is long in the X direction when seen in a thickness direction of the insulating substrate 20. In the embodiment, the first conductor pattern 22A has an elliptical shape formed by two semicircular arcs facing each other in the X direction and two straight lines connecting end points of the two semicircular arcs. More specifically, as illustrated in FIGS. 2 and 4, the first conductor pattern 22A is wound outward by three turns in the right direction when seen from above (Z direction). In the following description, the three turns of the first conductor pattern 22A are also referred to as a first turn 23*p*, a second turn 23*q*, and a third turn 23*r* in order from the inside. In the embodiment, a height of the first conductor pattern 22A (length of the insulating substrate 20 in the thickness direction) is the same over the entire length, and a height of the first turn 23*p*, a height of the second turn 23*q* and a height of the third turn 23*r* are equal.

Figure 3:
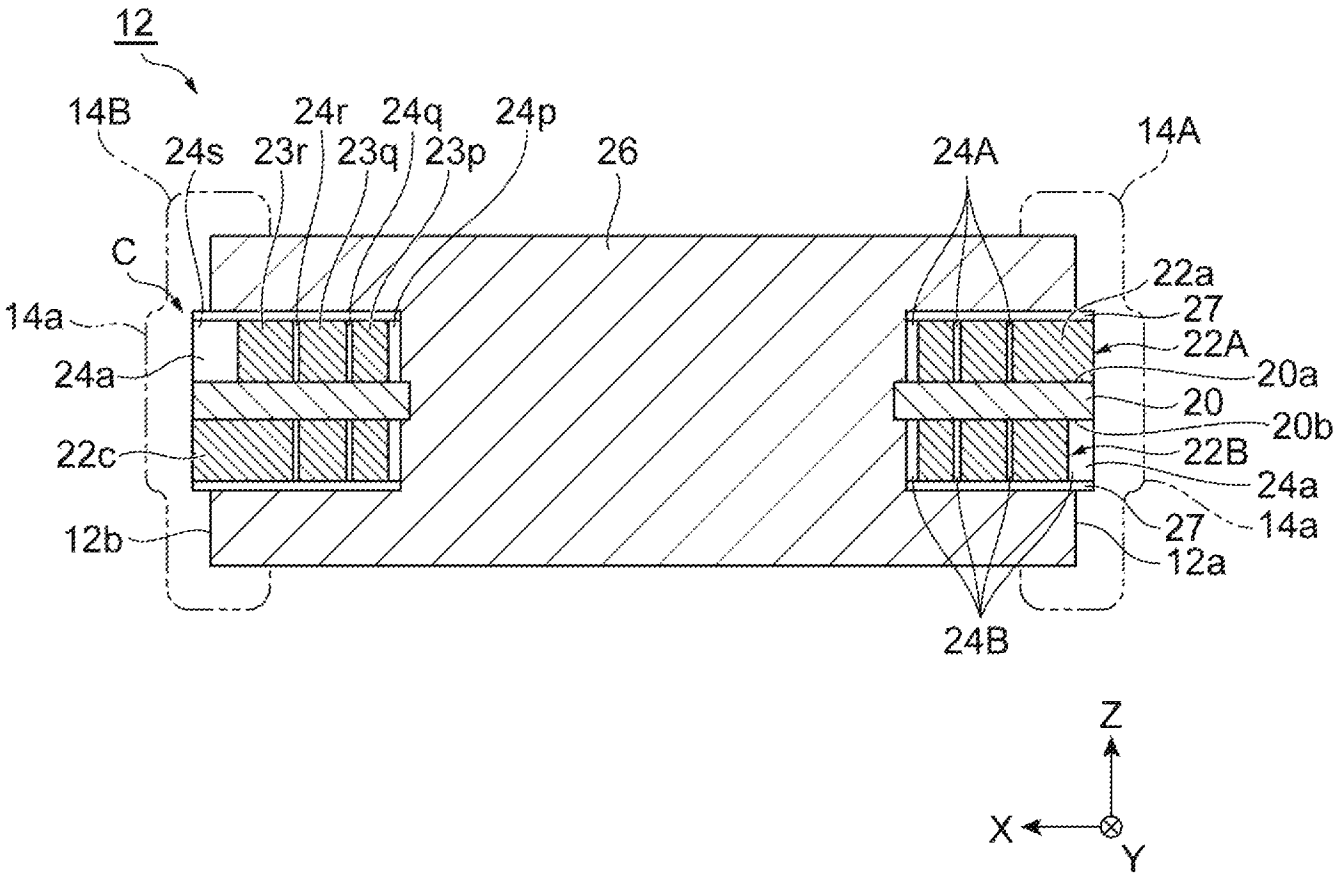
FIG. 3 is a cross-sectional view taken along line II-III of the planar coil element illustrated in FIG. 1.

As illustrated in FIG. 3, an outer end portion 22*a* of the first conductor pattern 22A is exposed and protrudes from the end surface 12*a* of the main body portion 12. The outer end portion 22*a* of the protruding portion protruding from the end surface 12*a* is connected to the external terminal electrode 14A covering the end surface 12*a*. An inner end portion 22*b* of the first conductor pattern 22A is connected to the through-hole conductor 25.

Like the first conductor pattern 22A, the second conductor pattern 22B (second coil conductor pattern) is also a planar spiral pattern which becomes a planar air-core coil and is plated with a conductive material such as Cu. The second conductor pattern 22B is formed to be wound around the through-hole 20*c* of the insulating substrate 20. That is, like the first conductor pattern 22A and the through-hole 20*c*, the second conductor pattern 22B also has an elliptical shape which is long in the X direction when seen in the thickness direction of the insulating substrate 20. In the embodiment, the second conductor pattern 22B has an elliptical shape formed by two semicircular arcs facing each other in the X direction and two straight lines connecting end points of the two semicircular arcs. More specifically, the second conductor pattern 22B is wound outward by three turns in the left direction when seen from above (Z direction). That is, the second conductor pattern 22B is wound in a direction opposite to the winding direction of the first conductor pattern 22A when seen from above. A height of the second conductor pattern 22B is the same over the entire length and can be designed to be the same as the height of the first conductor pattern 22A.

As illustrated in FIG. 3, an outer end portion 22*c* of the second conductor pattern 22B is also exposed and protrudes at the end surface 12*b* of the main body portion 12. The end portion 22*c* of the protruding portion projecting from the end surface 12*b* is connected to the external terminal electrode 14B covering the end surface 12*b*. An inner end portion 22*d* of the second conductor pattern 22B is aligned with the inner end portion 22*b* of the first conductor pattern 22A in the thickness direction of the insulating substrate 20 and connected to the through-hole conductor 25.

The through-hole conductor 25 is provided to pass through an edge region of the through-hole 20*c* of the insulating substrate 20 and connects the end portion 22*b* of the first conductor pattern 22A with the end portion 22*d* of the second conductor pattern 22B. The through-hole conductor 25 can be constituted by a hole provided in the insulating substrate 20 and a conductive material (a metal material such as Cu or the like) filled in the hole. The through-hole conductor 25 has a substantially columnar or substantially prismatic outer shape extending in the thickness direction of the insulating substrate 20.

Further, as illustrated in FIGS. 2 and 3, resin walls 24A and 24B are provided on the first conductor pattern 22A and the second conductor pattern 22B, respectively. For example, as illustrated in FIGS. 3 and 4, the resin walls 24A provided on the first conductor pattern 22A include a first resin wall 24*p* located inside the first turn 23*p*, a second resin wall 24*q* located between the first turn 23*p* and the second turn 23*q*, a third resin wall 24*r* located between the second turn 23*q* and the third turn 23*r*, and a fourth resin wall 24*s* located outside the third turn 23*r*. The fourth resin wall 24*s* includes an overlapping portion 24*a* overlapping the outer end portion 22*c* of the second conductor pattern 22B in the Z direction. Like the resin walls 24A provided on the first conductor pattern 22A, the resin walls 24B provided on the second conductor pattern 22B include a first resin wall located inside the first turn, a second resin wall located between the first turn and the second turn, a third resin wall located between the second turn and the third turn, and a fourth resin wall located outside the third turn. The fourth resin wall 24 of the resin walls 24B also includes an overlapping portion which overlaps the outer end portion 22*a* of the first conductor pattern 22A in the Z direction.

The resin walls 24A and 24B are formed of an insulating resin material. In the present embodiment, the resin walls 24A and 24B can be provided on the insulating substrate 20 before the first conductor pattern 22A or the second conductor pattern 22B is formed. The first conductor pattern 22A or the second conductor pattern 22B is plated and grown on walls defined by the resin walls 24A and 24B. The resin walls 24A and 24B used for the plating growth of the first conductor pattern 22A and the second conductor pattern 22B remain in the planar coil element 10.

As illustrated in FIGS. 2 and 3, the main body portion 12 has a magnetic element body 26 provided to cover one surface 20*a* and the other surface 20*b* of the insulating substrate. The magnetic element body 26 is formed of a resin containing a metal magnetic powder. For example, a thermosetting epoxy resin may be used as the resin forming the magnetic element body 26. The magnetic element body 26 integrally covers the first conductor pattern 22A, the second conductor pattern 22B, and the resin walls 24A and 24B with an insulating layer 27 interposed therebetween. Further, the magnetic element body 26 is filled inside the through-hole 20*c* of the insulating substrate 20, the first conductor pattern 22A and the second conductor pattern 22B. Furthermore, as illustrated in FIG. 4, the magnetic element body 26 covers the insulating substrate 20, the first conductor pattern 22A and the second conductor pattern 22B from the outside. The insulating layer 27 is provided to be interposed between the first conductor pattern 22A and the magnetic element body 26 and between the second conductor pattern 22B and the magnetic element body 26, thereby enhancing an insulating property between the metal magnetic powder contained in the magnetic element body 26 and the conductor patterns. The insulating layer 27 may be formed of an insulating resin or an insulating magnetic material.

The magnetic element body 26 forms an outer shape of the main body portion 12. Therefore, the pair of facing end surfaces 12*a* and 12*b* of the main body portion 12 are formed by the magnetic element body 26. The outer end portion 22*a* of the first conductor pattern 22A is exposed and protrudes from one end surface 12*a* of the pair of facing end surfaces 12*a* and 12*b* of the main body portion 12, and the outer end portion 22*c* of the second conductor pattern 22B is exposed and protrudes from the other end surface 12*b*. Further, the fourth resin wall 24*s* of the resin walls 24B is exposed and protrudes from the one end surface 12*a*, and the fourth resin wall 24*s* of the resin walls 24A is exposed and protrudes from the other end surface 12*b*.

The first external terminal electrode 14A of the pair of external terminal electrodes 14A and 14B covers the one end surface 12*a* of the main body portion 12 and is electrically connected to the outer end portion 22*a* of the first conductor pattern 22A which is exposed from the end surface 12*a*. The first external terminal electrode 14A has a protruding portion 14*a* protruding outward in a region in which the outer end portion 22*a* of the first conductor pattern 22A and the overlapping portion 24*a* of the fourth resin wall of the resin walls 24B protrude. The second external terminal electrode 14B of the pair of external terminal electrodes 14A and 14B covers the other end surface 12*b* of the main body portion 12 and is electrically connected to the outer end portion 22*c* of the second conductor pattern 22B exposed from the end surface 12*b*. Like the first external terminal electrode 14A, the second external terminal electrode 14B also has a protruding portion 14*a* protruding outward in a region in which the outer end portion 22*c* of the second conductor pattern 22B and the overlapping portion 24*a* of the fourth resin wall 24*s* of the resin walls 24A protrude.

Both the first external terminal electrode 14A and the second external terminal electrode 14B are resin electrodes formed of a conductive resin. Therefore, the first external terminal electrode 14A and the second external terminal electrode 14B can realize a high coupling force with the fourth resin walls exposed from the end surfaces 12*a* and 12*b* of the main body portion 12.

In the above-described planar coil element 10, since the first conductor pattern 22A and the second conductor pattern 22B approximately overlap in a state in which the insulating substrate 20 is interposed therebetween and both are disposed to surround the through-hole 20*c* of the insulating substrate 20, a magnetic core portion 30 of the coil C is defined by the through-hole 20*c* of the insulating substrate 20 and the air-core portions of the first conductor pattern 22A and the second conductor pattern 22B. The magnetic core portion 30 is filled with the magnetic element body 26.

In the planar coil element 10, since the first conductor pattern 22A and the second conductor pattern 22B of the coil C are wound in the opposite directions when seen from above, a current can flow through the first conductor pattern 22A and the second conductor pattern 22B connected by the through-hole conductor 25 in one direction. In the coil C, since the direction in which the current flows is the same in the first conductor pattern 22A and the second conductor pattern 22B when the current flows in one direction, magnetic fluxes generated in them are superimposed and strengthened.

Here, as illustrated in FIG. 4, in a width (length in the X direction) of the resin walls 24A, assuming that widths of the first resin wall 24*p*, the second resin wall 24*q*, the third resin wall 24*r*, and the fourth resin wall 24*s* are W11, W21, W31, and W41, respectively, the width W41 of the fourth resin wall 24*s* is formed to be wider than any of the widths W11, W21, and W31. In particular, the width W41 of the fourth resin wall 24*s* is formed to be wider than the widths W21 and W31 of the second resin wall 24*q* and the third resin wall 24*r* located between the turns of the first conductor pattern 22A.

In the above-described planar coil element 10, since the overlapping portion 24*a* of the fourth resin wall 24*s* protrudes from the other end surface 12*b* (second end surface) of the main body portion 12, the restriction on the width of the overlapping portion 24*a* in the X direction is relaxed, and the wide overlapping portion 24*a* is realized. Therefore, as illustrated in FIG. 3, an improvement in a withstand voltage between the second external terminal electrode 14B formed on the end surface 12*b* and the third turn 23*r* (outermost turn) of the first conductor pattern 22A is realized. Similarly, regarding the second conductor pattern 22B, the overlapping portion 24*a* of the fourth resin wall protrudes from the one end surface 12*a* (first end surface) of the main body portion 12, the restriction on the width of the overlapping portion 24*a* in the X direction is relaxed, the wide overlapping portion 24*a* is realized, and thus the improvement in the withstand voltage between the first external terminal electrode 14A formed on the end surface 12*a* and the outermost turn of the second conductor pattern 22B is realized.

What is claimed is:

1. A coil component comprising:

a main body portion comprising:

a first end surface and a second end surface facing each other;

an insulating substrate extending in a direction that the first end surface and the second end surface face each other;

a coil comprising:

a first coil conductor pattern disposed on a first surface of the insulating substrate;

a second coil conductor pattern disposed on a second surface of the insulating substrate opposite the first surface in a thickness direction of the insulating substrate and wound in a direction opposite to that of the first coil conductor pattern when seen in the thickness direction of the insulating substrate; and a through-hole conductor passing through the insulating substrate and connecting inner ends of the first coil conductor pattern and the second coil conductor pattern;

a first resin wall between turns of the first coil conductor pattern and disposed on an inner side of an innermost turn and on an outer side of an outermost turn of the first coil conductor pattern;

a second resin wall between turns of the second coil conductor pattern and disposed on an inner side of an innermost turn and on an outer side of an outermost turn of the second coil conductor pattern;

a first protruding portion that protrudes from the first end surface of the main body portion, the first protruding portion comprising:

an outer end portion of the first coil conductor pattern;

an extending portion of the second resin wall; and a first overlapping portion of the insulating substrate that overlaps the outer end portion of the first coil conductor pattern and the extending portion of the second resin wall in the thickness direction of the insulating substrate;

a second protruding portion that protrudes from the second end surface of the main body portion, the second protruding portion comprising:

an outer end portion of the second coil conductor pattern;

an extending portion of the first resin wall; and a second overlapping portion of the insulating substrate that overlaps the outer end portion of the second coil conductor pattern and the extending portion of the first resin wall in the thickness direction of the insulating substrate;

a magnetic element body provided on the first and second surfaces of the insulating substrate to cover the first coil conductor pattern, the second coil conductor pattern, and the first and second resin walls and forming an outer shape including the first and second end surfaces of the main body portion;

a first step formed between the first protruding portion of the main body portion and the first end surface of the main body portion; and a second step formed between the second protruding portion of the main body portion and the second end surface of the main body portion;

a first external terminal electrode disposed on the first end surface of the main body portion and connected to the first coil conductor pattern, the first external terminal electrode covering the first protruding portion of the main body portion; and a second external terminal electrode disposed on the second end surface of the main body portion and connected to the second coil conductor pattern, the second external terminal electrode covering the second protruding portion of the main body portion.

2. The coil component according to claim 1, wherein a width of the extending portion of the first resin wall is wider than a width of a portion of the first resin wall positioned between the turns of the first coil conductor pattern.

3. The coil component according to claim 1, wherein the first external terminal electrode protrudes outward in a region which covers the first protruding portion of the main body portion.

4. The coil component according to claim 1, wherein the first external terminal electrode and the second external terminal electrode are resin electrodes.

5. The coil component according to claim 1, wherein each of the first coil conductor pattern and the second coil conductor pattern has an elliptical shape formed by two semicircular arcs facing each other in the direction that the first end surface and the second end surface face each other and two straight lines connecting end points of the two semicircular arcs when seen in the thickness direction of the insulating substrate.

* * * * *